US011386762B2

(12) United States Patent
Meron et al.

(10) Patent No.: US 11,386,762 B2
(45) Date of Patent: Jul. 12, 2022

(54) OBSCURATION CLOUD GENERATOR

(71) Applicant: Essence Security International (E.S.I.) Ltd., Herzlia Pituach (IL)

(72) Inventors: Sergey Meron, Netanya (IL); Avi Zeilig, Rosh HaAyin (IL); Pavel Lindberg, Rosh HaAyin (IL)

(73) Assignee: Essence Security International (E.S.I.) Ltd., Herzlia Pituach (IL)

( * ) Notice: Subject to any disclaimer, the term of this patent is extended or adjusted under 35 U.S.C. 154(b) by 0 days.

(21) Appl. No.: 17/415,123

(22) PCT Filed: Dec. 18, 2019

(86) PCT No.: PCT/IL2019/051387
§ 371 (c)(1),
(2) Date: Jun. 17, 2021

(87) PCT Pub. No.: WO2020/129063
PCT Pub. Date: Jun. 25, 2020

(65) Prior Publication Data

US 2022/0044536 A1 Feb. 10, 2022

(30) Foreign Application Priority Data

Dec. 18, 2018 (IL) ..... 263810

(51) Int. Cl.
*G08B 15/02* (2006.01)
*G08B 29/04* (2006.01)

(52) U.S. Cl.
CPC ..... *G08B 15/02* (2013.01); *G08B 29/046* (2013.01)

(58) Field of Classification Search
CPC ..... G08B 15/02; G08B 29/046; E05G 1/12; F41H 9/04; F41H 9/06; F41H 9/08
(Continued)

(56) References Cited

U.S. PATENT DOCUMENTS 4,024,986 A * 5/1977 Fegley ..... G08B 15/02 222/5
4,062,303 A * 12/1977 Fegley ..... E05G 5/02 109/29
(Continued)

FOREIGN PATENT DOCUMENTS

DE 29520736 3/1996
EP 2778599 9/2014
(Continued)

OTHER PUBLICATIONS

International Search Report and the Written Opinion dated Jul. 2, 2020 From the International Searching Authority Re. Application No. PCT/IL2019/051386. (27 Pages).
(Continued)

*Primary Examiner* — Lloyd A Gall

(57) ABSTRACT

An obscuration cloud generation device (100) comprises a housing (101) having a door (102) and a frame (103) sized and shaped to accommodate an obscuration cloud generating canister (110) when the door (102) is in a closed state. Activation of the canister (110) emits a composition for forming the cloud. The door (102) has an operably open state in which the door (102) is open at least a predefined minimum extent for exiting of the emitted composition. A door checking system (104) applies a force for opening the door (102) and generates an indication of whether the door (102) is open at least to the minimum extent. A controller (105) is adapted to instruct the checking system (104) to apply the force and to receive the indication to determine, before activating the canister (110), that the door (102) is not blocked from reaching the operably open state.

18 Claims, 11 Drawing Sheets

(58) Field of Classification Search
USPC ..... 109/23–34; 116/75, 214; 222/3
See application file for complete search history.

(56) References Cited

U.S. PATENT DOCUMENTS

| | | | | |
|---|---|---|---|---|
| 4,062,473 | A * | 12/1977 | Fegley | G08B 13/00 222/5 |
| 11,045,820 | B2 * | 6/2021 | Echeverria | F41H 9/08 |
| 2017/0209840 | A1 | 7/2017 | Swallow et al. | |
| 2018/0126394 | A1 * | 5/2018 | Echeverria | B05B 1/262 |
| 2022/0044535 | A1 | 2/2022 | Meron et al. | |

FOREIGN PATENT DOCUMENTS

| | | |
|---|---|---|
| EP | 3319056 | 5/2018 |
| ES | 2609752 | 8/2020 |
| GB | 2048534 | 12/1980 |
| GB | 2449678 | 12/2008 |
| JP | 2015-043143 | 3/2015 |
| WO | WO 2020/129062 | 6/2020 |
| WO | WO 2020/129063 | 6/2020 |

OTHER PUBLICATIONS

International Search Report and the Written Opinion dated Mar. 2, 2020 From the International Searching Authority Re. Application No. PCT/IL2019/051387. (12 Pages).

Invitation to Pay Additional Fees, Communication Relating to the Results of the Partial International Search and the Provisional Opinion dated Mar. 25, 2020 From the International Searching Authority Re. Application No. PCT/IL2019/051386. (17 Pages).

XAFER Security Components "XAFER Security Components. Corporate Video ENG 2.0", Retrieved from the Internet. Published Jun. 26, 2018, 1 page.

Office Action dated Sep. 12, 2021 From the Israel Patent Office Re. Application No. 263810 and Its Translation Into English. (4 Pages).

Office Action dated Dec. 21, 2021 From the Israel Patent Office Re. Application No. 263811. (4 Pages).

International Preliminary Report on Patentability dated Jul. 1, 2021 From the International Bureau of WIPO Re. Application No. PCT/IL2019/051386. (21 Pages).

International Preliminary Report on Patentability dated Jul. 1, 2021 From the International Bureau of WIPO Re. Application No. PCT/IL2019/051387. (8 Pages).

* cited by examiner

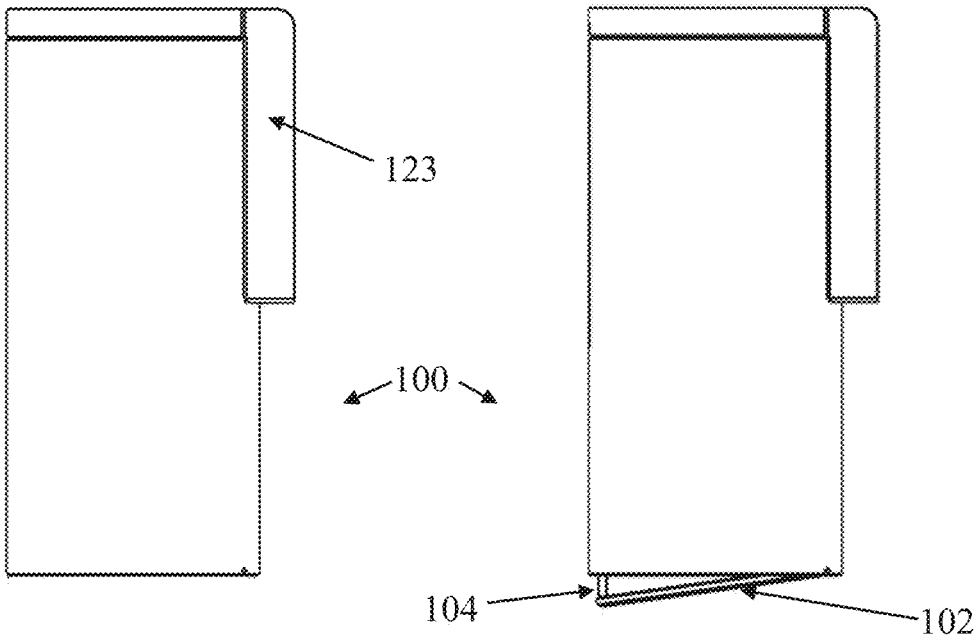
FIG. 2A FIG. 2B
FIG. 3
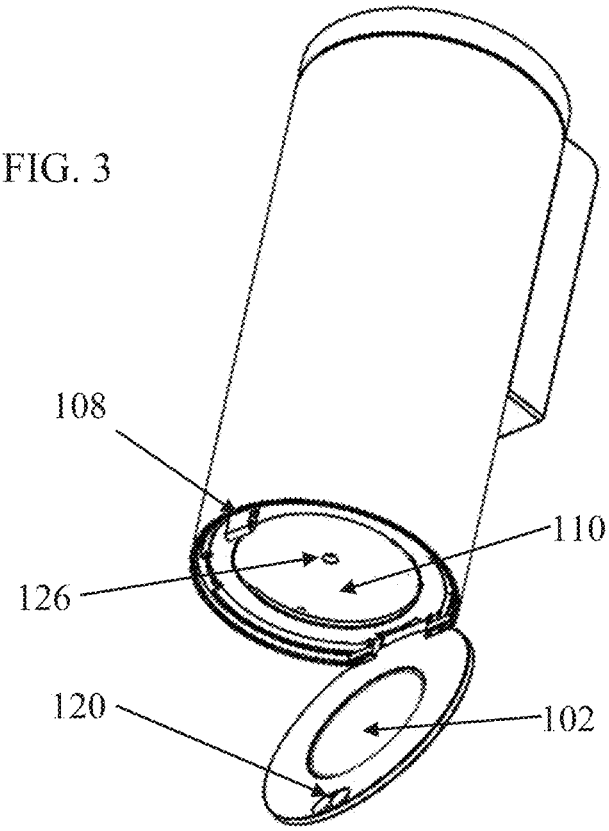

OBSCURATION CLOUD GENERATOR

RELATED APPLICATIONS

This application is a National Phase of PCT Patent Application No. PCT/IL2019/051387 having International filing date of Dec. 18, 2019, which claims the benefit of priority of Israel Patent Application No. 263810 filed on Dec. 18, 2018. The contents of the above applications are all incorporated by reference as if fully set forth herein in their entirety.

PCT Patent Application No. PCT/IL2019/051387 application is also related to co-filed PCT Patent Application entitled "OBSCURATION CLOUD GENERATOR", which claims the benefit of priority from Israel Patent Application No. 263811 filed on Dec. 18, 2018, the contents of which are incorporated herein by reference in their entirety.

FIELD AND BACKGROUND OF THE INVENTION

The present invention, in some embodiments thereof, relates to an obscuration cloud generation device and, more particularly, but not exclusively, to methods, devices and computer readable mediums for verifying operability of an obscuration cloud generation device.

An obscuration cloud generator (e.g. a smoke screen generator or other particle cloud generator) may be triggered to generate an obscuration cloud by an alert condition in order to ward off an intruder. For example, in response to a detection of an intruder, e.g. by a passive infrared detector (PIR) or other sensor, a smoke generator may be triggered to generate and release smoke to scare off the intruder.

The obscuration cloud generator includes a canister which may generate an obscuration cloud by releasing a pressured gas and/or by generating and releasing a gas at high pressure by means of exothermic reaction. The obscuration cloud generator normally includes a closure which is pushed out by the pressure of emission when the gas is released.

Reference to any prior art in this specification is not an acknowledgement or suggestion that this prior art forms part of the common general knowledge in any jurisdiction, or globally, or that this prior art could reasonably be expected to be understood, regarded as relevant/or combined with other pieces of prior art by a person skilled in the art.

SUMMARY OF THE INVENTION

Various aspects and embodiments of the present disclosure are defined by the appended claims. Other aspects and/or embodiments of the present invention will be apparent from the description which follows. It will be appreciated that features and aspects of the present disclosure may be combined with other different aspects of the disclosure as appropriate, and not just in the specific illustrative combinations described herein.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. Like numerals in different figures are intended to refer to the same parts or, if required by the context, corresponding similar parts.

In the drawings:

FIGS. 2A and 2B are schematic illustrations of a side view of the obscuration cloud generation device of FIG. 1, with the door closed and with the door open to a predefined minimum extent for releasing an obscuration cloud, respectively, according to some embodiments of the present invention;

FIG. 3 is a schematic illustration of the bottom part of the obscuration cloud generation device of FIG. 1 with the door fully open, according to some embodiments of the present invention;

DESCRIPTION OF EMBODIMENTS OF THE INVENTION

Figure 1:
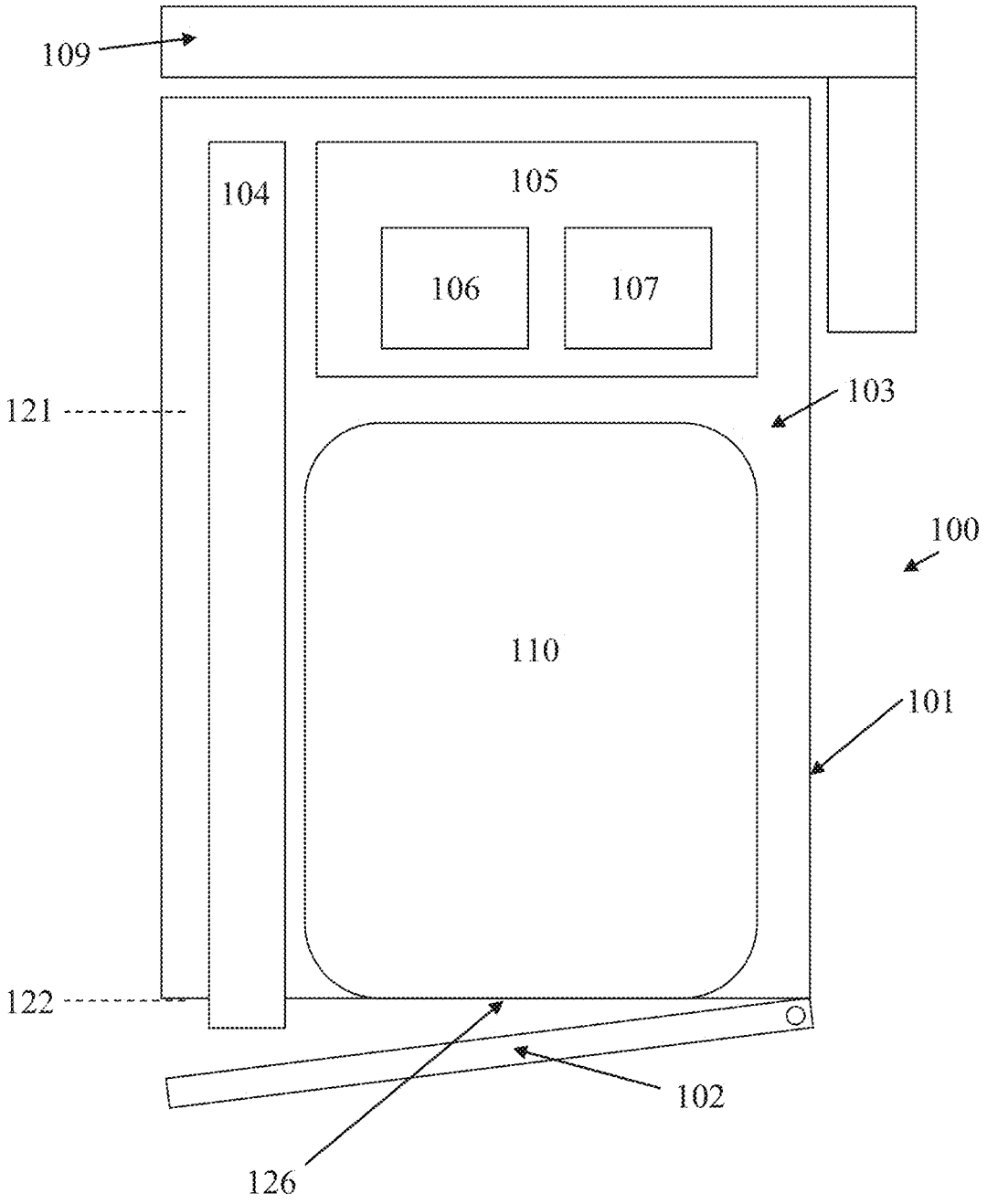
FIG. 1 is a schematic illustration of an exemplary obscuration cloud generation device, according to some embodiments of the present invention.

The present invention, in some embodiments thereof, relates to an obscuration cloud generation device and, more particularly, but not exclusively, to methods, devices and computer readable mediums for verifying operability of an obscuration cloud generation device.

A security system may include and control an obscuration cloud generating device. Such an obscuration cloud generation device may be sabotaged by blocking the release of the obscuration cloud. This may be done for example by covering or masking the outlet of the canister or the device that holds the canister. For example, the device may have a part that covers the outlet and which is designed to be blown off by a composition (for example, but not necessarily, a gaseous composition) that is emitted to form the cloud and uncovers the device due to the pressure of the emission, but by sabotage/tampering the covering part may be held in place by masking tape, keeping the device closed. A would-be intruder may attempt to avoid detection, for example, by visiting the site on an earlier occasion (when the security system is unarmed, i.e. not monitoring) and sabotaging the device so that when they later intrude the building (when the security system is armed) the device will be unable to emit the obscuration cloud since device is held closed. Not only could such tampering cause failure of the device, it may also lead to an explosion and/or surrounding damage, because of high pressures and/or heat generated that come with the obscuration cloud generation, e.g. by an exothermic reaction.

According to some embodiments of the present invention, there is provided an obscuration cloud generation device which detects an ability and/or inability to sufficiently displace the cover.

For example, in some embodiments, a device includes a housing having a door and a frame constructed to accommodate an obscuration cloud generating canister, a door checking system and a controller adapted to control the operation of the device. The controller instructs the door checking system to apply a force for opening the door, to at least a predefined minimum extent. The door checking system tries to open the door and indicates whether the door opened to an operably open state being a state in which the door is open at least the predefined minimum extent for activation of the obscuration cloud generation in a safety risk mitigated manner and/or a more effective manner than were the door held closed. The controller then receives the indication and determines whether it is able to activate the obscuration cloud generation in such an "operable" manner.

When the controller determines that the canister is able to be operably activated (in the sense that the door can be sufficiently opened), and receives a request to activate the canister, the controller activates the canister, causing an emission of a composition that forms the cloud upon mixing with surrounding atmospheric air. Optionally, when the controller determines that the canister is unable to be operably activated (when the door is blocked), an alert may be triggered to inform of the blocked state. The alert may be directed to a person, an administrator and/or a computer, and/or may be transmitted to a monitoring hub and/or may be indicated from the device itself by a visual and/or audio signal, for example.

According to some embodiments, the door checking system includes a pushing member, which extends along the frame and which is displaced, in some embodiments longitudinally, to push the door open. The pushing member may be moved for example by a motor connected to the pushing member for example by use of an eccentric shaft a slotted shaft or another rotational to linear movement conversion mechanism, or by a solenoid which creates magnetic field to move the pushing member. However, some embodiments, designed to optimize energy efficiency, a motor is more specifically used to move the pushing member. Optionally, the pushing member may also be used as a releasing mechanism for the door, allowing the door to be opened for example by gravity.

The indication of whether the door opened at least the predefined minimum extent may be generated for example by a measuring overcurrent of the motor. The indication may also be generated for example by a sensor measuring the displacement of the pushing member, such as a magnetic or optical sensor, or a switch actuated by the pushing member moving a predefined distance.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Referring now to the drawings, FIG. 1 is a schematic illustration of an exemplary obscuration cloud generation device, according to some embodiments of the present invention. Device 100 includes a mounting portion 109 removably attached to a housing 101, the housing 101 having a door 102 and a frame 103. Housing 101 may be made, for example, from a high temperature plastic, having for example a melt temperature between of at least 280° C., which in some embodiments is between 280° C. and 320° C.

Frame 103 is sized and shaped to accommodate an obscuration cloud generating canister 110. Frame 103 for example has a cylindrical cavity for containing the canister or, in some embodiments, for containing a shell/container that in turn contains the canister. In some embodiments the canister is sized to be held by a single hand.

The obscuration cloud generating canister 110, in some or all of examples herein, contains combustible material which upon activation of the canister, by application of a voltage to the canister, undergoes an exothermic reaction to produce particles to create the cloud, for example a smoke cloud. The obscuration cloud generating canister 110 may be disposable and should be replaced after it has been activated. The obscuration cloud generating canister 110 may be provided separately from device 100, or may be purchased from a third party.

During normal use, when the cloud generating canister 110 is activated (by application of a predefined voltage across a pair of terminals extending from the canister cylinder), one or more gaseous jets of the cloud-forming composition are emitted from a bottom outlet 126 of the cloud generating canister 110 and push the door 102, by the pressure of the emission. Alternatively, the door 102 may be opened before the emission. The door therefore acts as the outlet of device 100. The door 102 may be opened fully, as in normal operation, or at least to a predefined minimum extent, for example if the door 102 has been tampered with but unsuccessfully, such that the door can still open sufficiently for successful operation. The operably open state in which the door is opened at least to a predefined minimum extent may, in some or all of the embodiments, be defined by the ability of the emitted composition to successfully exit the opening that is created by the opened door 102. In this operably open state, the door is sufficiently open for the cloud-forming composition to be emitted from the device without damaging the device (by allowing sufficient heat/energy to pass out of the device). The success of the exit may be quantified as minimum exit rate for a mitigation of a safety and/or operational hazard (e.g. an explosion and/or overheating of the housing or components therein). In normal operation, when the door is opened fully by the pressure of emission or before emission, there might be better distribution of the obscuration cloud, but this is not necessary to be "operable". In some embodiments, sufficient "operability" is provided by having the minimum extent of opening of the door providing an opening that is at least 10 times the opening area as the opening area of the canister outlet 126 (or in the case of multiple outlets, their combined area), and in some embodiments at least 20 times, and in some embodiments at least 30 times, and in some embodiments, at least 50 times.

Reference is now made to FIGS. 2A and 2B, which are schematic illustrations of a side view of the obscuration cloud generation device of FIG. 1, with the door closed and with the door open to a predefined minimum extent for releasing a jet of a composition for forming an obscuration cloud, respectively, according to some embodiments of the present invention. Reference is also made to FIG. 3, which is a schematic illustration of the bottom part of the obscuration cloud generation device of FIG. 1 with the door fully open, according to some embodiments of the present invention.

Device 100 also includes a controller 105 adapted to operate device 100. Controller 105 includes a processing circuitry 106 (FIG. 1) which executes instructions stored in a memory 107. Processing circuitry 106 may include a single processor or one or more processors arranged for parallel processing, such as clusters and/or as one or more multi core processor(s), and/or any other processing hardware. Memory 107 may comprise a plurality of memory components. Memory 107 may include one or more non-transient computer readable medium, which stores instructions for operating device 100 that are read by processing circuitry 106. The non-transient memory may include, for example, a hard drive, a Flash array and/or the like.

The controller 105 and the door 102 may be positioned at opposite ends of the frame 103. For example, top end 121 and bottom end 122. This allows easy access to the canister from the door 102, without being blocked by the electronics of the controller 105. The term "end" in this context should be understood broadly to mean positioned above or below of the obscuration cloud generating canister 110. This may mean, for example, being adjacent to the obscuration cloud generating canister 110 or adjacent to the edges of frame 103.

Figure 4A:
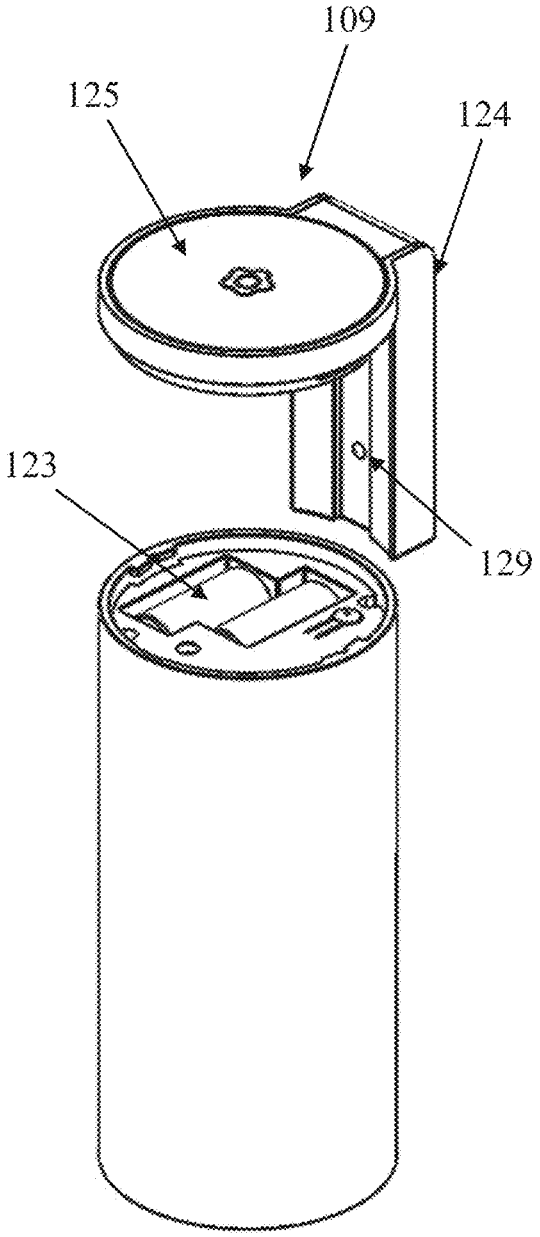
FIGS. 4A and 4B are illustrations of the top part of the obscuration cloud generation device of FIG. 1, showing a housing removed from a mounting portion and respectively showing the batteries inserted inside the housing and removed from the housing, respectively, according to some embodiments of the present invention.
Figure 4B:
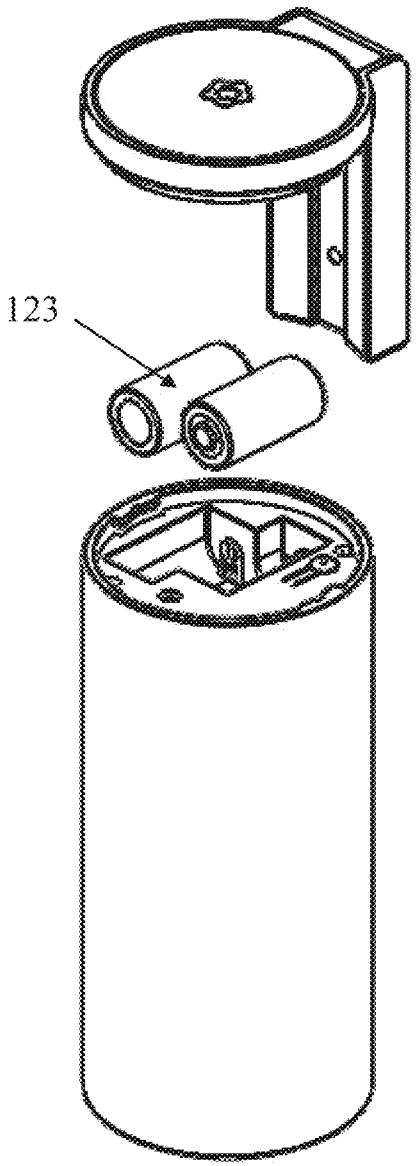

Device 100 may also include a power source, such as one or more batteries. Reference is now made to FIGS. 4A and 4B, which are illustrations of the top part of the obscuration cloud generation device of FIG. 1, showing the housing removed from a mounting portion 109 and respectively showing the batteries 123 inserted inside the housing and removed from the housing, respectively, according to some embodiments of the present invention. In this case, energy consumption of the door checking system is important, to avoid the need to replace the batteries often.

Device 100 also includes a mounting portion 109. The mounting portion includes a bracket 124 for mounting with one or more mounting features 129 (e.g. screw holes) for mounting the bracket 124 to a vertical wall so the housing 101 has a longitudinal axis that is parallel with the wall. In some embodiment, longitudinal axis is more specifically vertical with the housing 101 extending down from a housing-holding part 125 of the mounting portion 123.

Optionally, frame 103 is sized and shaped to accommodate a cylindrical inner shell 127 (shown in FIG. 6B, but not in FIG. 1) that holds the obscuration cloud generating canister 110, within the cylindrical cavity. The inner shell 127 surrounds the obscuration cloud generating canister 110. The inner shell may be inserted via the opening of housing 101, with the obscuration cloud generating canister 110 included within it. The inner shell 127 is in some embodiments made from a high temperature plastic, having for example a melt temperature between of at least 280° C., which in some embodiments is between 280° C. and 320° C. The inner shell may be shaped to shield at least the controller 105, and/or all or substantially all of the door checking system (e.g. the electronic components of the door checking system 104 and the pushing member), from the heat generated by the canister when activated.

Device 100 also includes a door checking system 104 that pushes door 102 to at least partially open it. The extent in which the door 102 is opened by the pressure of emission may be substantially greater than the extent in which the door is opened by the door checking system. In this context, "substantially greater" means that whereas the door checking system 104 may, in some embodiments, open the door only to the predefined minimum extent, which may only be enough for safe operation of the device, the pressure of emission may, by contrast, open the door fully, or to any extent that allows improved or ideal spreading of the obscuration cloud. For example, in the predefined minimum extent the hinge of the door may be opened to an angle of between 5 and 20 degrees, for example about 10 degrees, while in substantially the greater extent of opening the hinge of the door may be opened to an angle of at least 60 degrees, or at least 70 degrees or at least 80 degrees, or at least 90 degrees.

The door checking system 104 may comprise a pushing member extending along the frame 103 and which is displaced to push the door 102. The pushing member may be, for example, an elongated rod 108 extending along the frame 103. This allows the door checking system 104 to be operated by the controller 105 and open the door 102, when the controller 105 and the door 102 are positioned at opposite ends of the frame 103, more specifically respectively above and below obscuration cloud generating canister 110. The rod 108 is in some embodiments made of a ferromagnetic material. The rod 108 is in some embodiments positioned between the inner shell 127 and the housing 101, so that the rod is insulated from the obscuration cloud generating canister 110 by the inner shell 127.

Figure 5B:
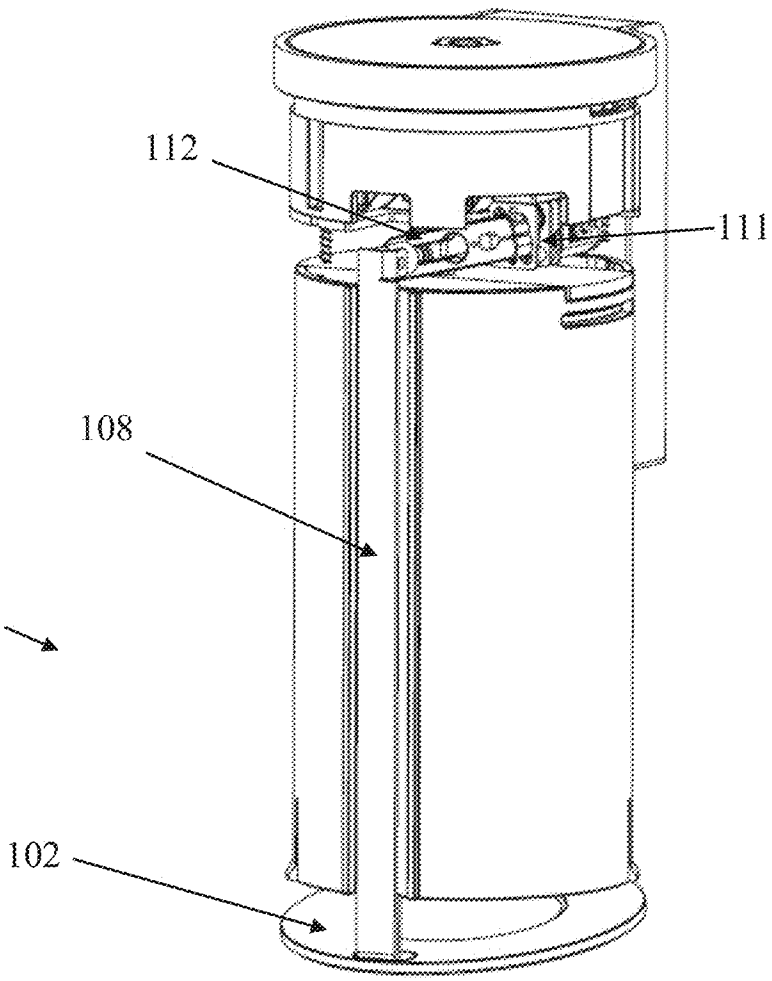
FIGS. 5A and 5B are illustrations of a transparent side view of an obscuration cloud generation device, with the door closed and with the door open, respectively, according to some embodiments of the present invention.
Figure 5A:
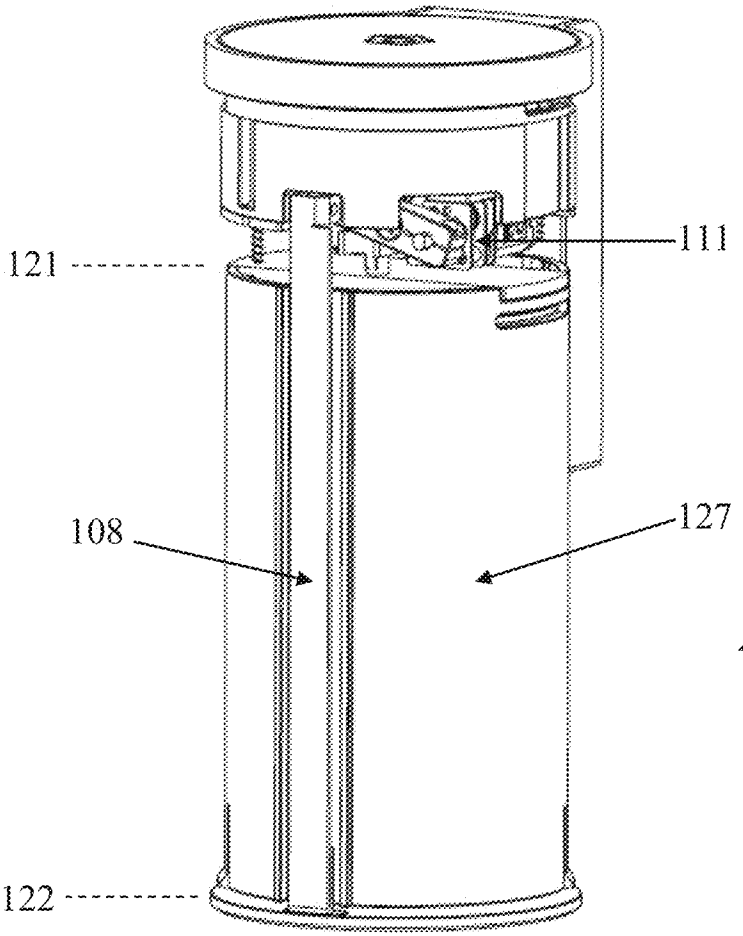
Figure 6B:
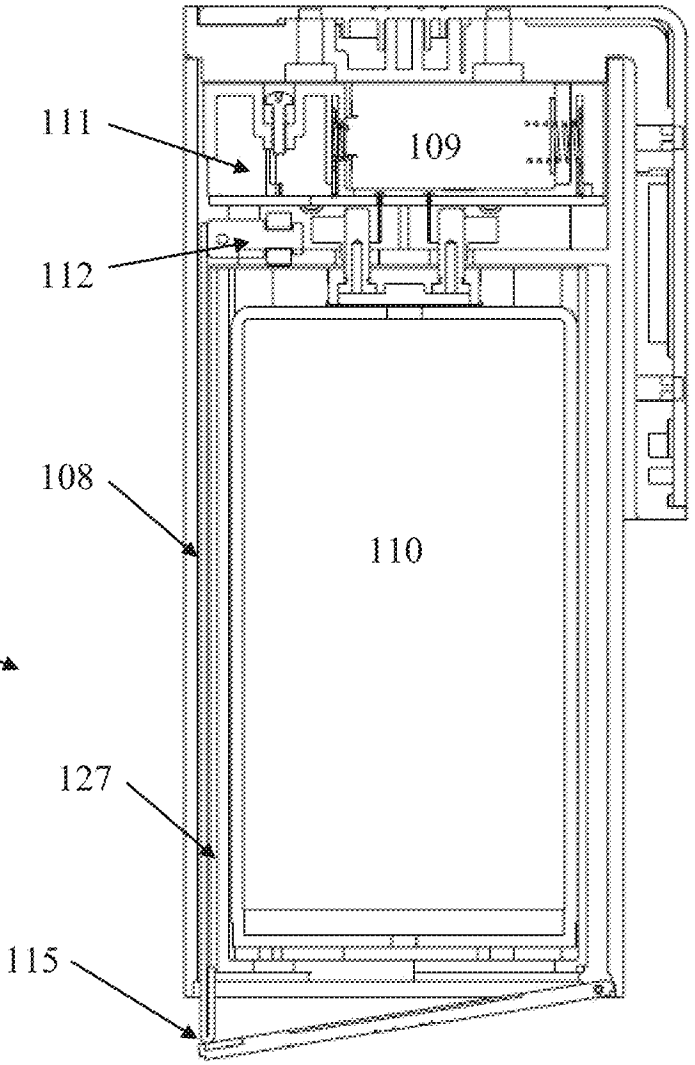
FIGS. 6A and 6B are illustrations of a cross-sectional view of an obscuration cloud generation device, with the door closed and with the door open, respectively, according to some embodiments of the present invention.
Figure 6A:
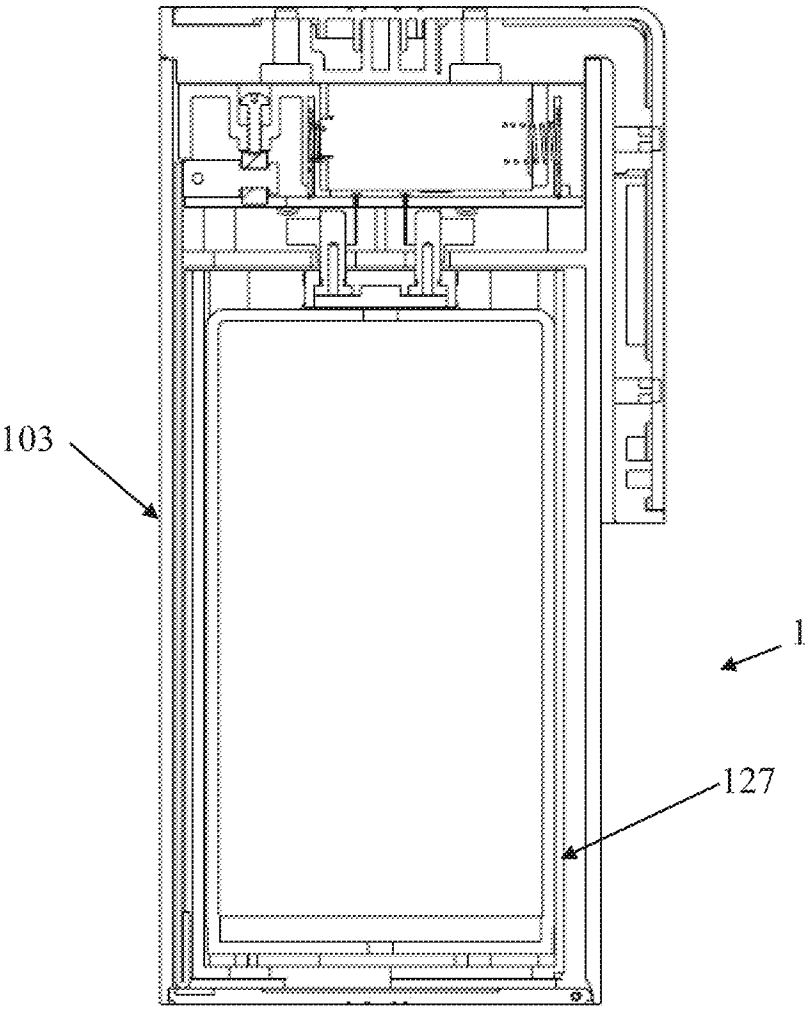

Reference is now made to FIGS. 5A and 5B, which are illustrations of a transparent side view of an obscuration cloud generation device, with the door closed and with the door open, respectively, according to some embodiments of the present invention. The frame 103 of housing 101 is not shown in these figures, so the inner parts are visible. Reference is also made to FIGS. 6A and 6B, which are illustrations of a cross-sectional view of an obscuration cloud generation device, with the door closed and with the door open, respectively, according to some embodiments of the present invention.

The door checking system 104 may comprise a motor 111, as is the case in the embodiment of FIGS. 5A, 5B, 6A and 6B. The motor 111 creates rotary movement, which is transferred to linear displacement of the pushing member. Motor 111 may be, for example, a stepper or DC motor, but in some embodiments is more specifically a DC motor to save costs.

Figure 7:
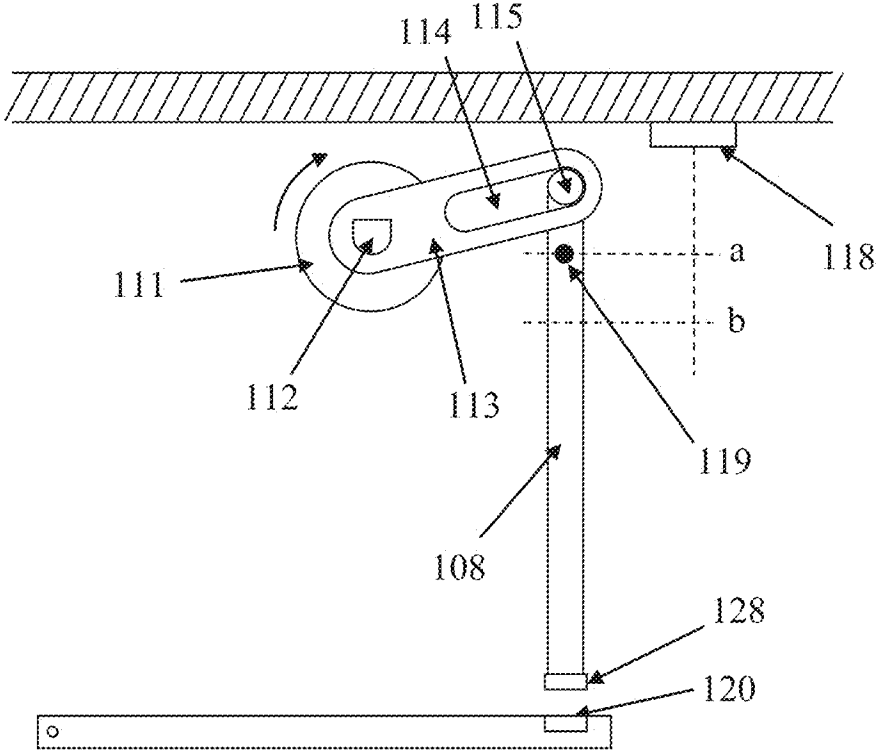
FIG. 7 is a schematic illustration of a motor-based door checking system, according to some embodiments of the present invention.

Reference is also made to FIG. 7, which is a schematic illustration of such a motor-based door checking system, according to some embodiments of the present invention. Motor 111 has a spindle 112 having a keyed (D-shaped) head for fixedly connecting to a shaft 113. The shaft has a slot 114 which receives within it an arm 115 that extends perpendicularly (out of the page) from the ferromagnetic and elongated rod 108. As the shaft 113 rotates, arm 115 is pushed down, sliding in the slot 114 as needed, thus transferring the rotational motor movement to a linear movement of the rod 108. In other embodiments, other rotational-linear motion conversion mechanisms known to the person skilled in the art may be used, for example having a shaft attached to but eccentric with the motor spindle.

In an alternative embodiment (not shown) the rod 108 is pushed by a piezoelectric motor, instead of a DC or stepper motor.

Alternatively, according to some embodiments, the door checking system 104 comprises a solenoid which creates linear displacement of the pushing member.

Figure 8:
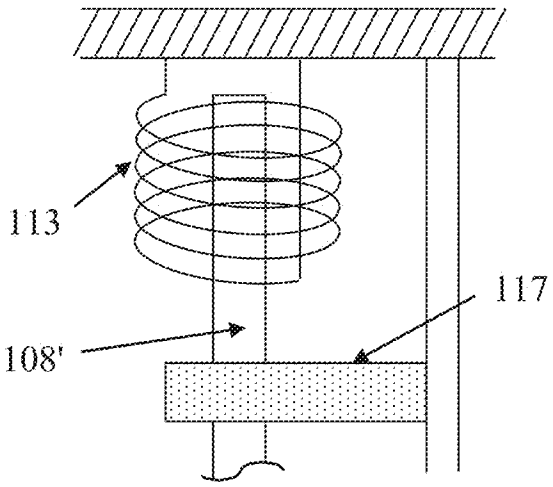
FIG. 8 is a schematic illustration of a solenoid-based door checking system, according to some embodiments of the present invention.

FIG. 8 is a schematic illustration of an exemplary solenoid-based door checking system, according to some embodiments of the present invention. A coil (e.g. in the form of solenoid) 113 produces a magnetic field, which moves a magnetic rod 108' up or down, as commanded, according to a generated magnetic field caused by a current supplied to the coil.

Thus, as will be appreciated from the above examples the door can be opened via a mechanically and/or electromagnetic drive, e.g. a motor or solenoid drive upon the rod 108 or 108'.

The door checking system 104 also generates an indication of whether the door is open at least to the predefined minimum extent. This may be measured in any one or more ways which are indicative of an extent of movement of rod 108 or 108'.

The indication may be determined for example by measuring a displacement of the pushing member. This may be measured by one or more sensors, such as magnetic sensor, optic sensor and/or any other sensor. For example, a linear encoder 117 may be used as shown at FIG. 8.

In another example, a magnetic sensor 118 (such as a Hall Effect sensor) is used, as shown at FIG. 7. The magnetic sensor 118 may be positioned in a circuit board mounted above the rod 108. A magnet 119 is positioned at top end of the pushing member, for example on rod 108 or on an end of the arm 115 (as shown in FIG. 7), near the circuit board. The further away the magnet 119 from the magnetic sensor 118, the less the magnetic field. The magnetic field is measured by the magnetic sensor 118 and sent to the controller 105. The open and closed states of the door 102 and the corresponding sensed magnetic fields are calibrated during manufacturing the device 100, by measuring the magnetic fields at each state of rod 108 (points 'a' and 'b' in FIG. 7), corresponding to the closed-door and partially-open-door positions.

In some embodiments, in addition or as an alternative to determining the indication by measuring a displacement, the indication is determined by measuring overcurrent of the motor. If the motor pushes the rod 108 against the door 102 but the door 102 is blocked so that it cannot reach the predefined partially open position, the current in the motor rises because of the resistance to the movement. This change in current may be detected by controller 105 and indicate that the door 102 is blocked.

The motor may be driven until either (i) an electrical threshold has been reached (e.g. an overcurrent condition) that indicates an overload condition; or (ii) a measured indication of displacement (e.g. using the above described hall effect sensor or linear encoder). If the overload condition is reached before the measured displacement of the door is indicated as having reaching the predefined minimum extent, the controller can determine that the door cannot sufficiently open.

In some embodiments a stepper motor may be used to move the pushing member. The controller can be configured to know how many steps of the stepper motor are required to move the door from its closed position to a predefined partially open position. If an overcurrent is sensed despite the number of commanded steps not being greater than the known amount needed, then the controller may determine that the door is blocked.

For any case, the controller may receive an indication that the door has not opened to the predefined extent by virtue of an absence of a change of state from an in input to the controller, wherein the change of state occurs if and when the door opens to the predefined extent. For example, if an input to the controller 105 measures a displacement at a binary level (e.g. a switch) or a more granular level (e.g. a linear encoder or magnetic sensor), and the measurement does not indicate that the door has opened to the predefined extent within a predefined time period of being commanded to do so, the time-out of the clock may be considered the receipt of an indication that the door has cannot be opened to the predefined extent. The indication for either the motor embodiment or the solenoid embodiment, may alternatively be determined by a mechanical switch, which is flipped by the rod 108 or a part extending therefrom when rod 108 reaches a predefined position, and is flipped back when rod 108 returns to the original position (in some embodiments) or when the rod 108 has at least retracted from the predefined position (in other embodiments).

The indication may be determined for example, alone or in part, by a predefined threshold of the displacement of rod 108, wherein when the displacement is below the predefined threshold, the door 102 is not considered to have reached the predefined minimum extent of being open. The threshold may be for example 5 millimeters, which to provide context is for a door that has a diameter between 60 and 65 millimeters. Generally, the value of the threshold is the same the size as the predefined minimum extent of opening the door 102. However, optionally the predefined minimum extent of opening the door is larger than needed for safety and/or effectiveness of operating the canister operation.

The door checking system 104 may also be operable to close the door 102 by retracting the pushing member. This may be done by an instruction from the controller 105, after controller 105 has received the indication of whether the door 102 is open to the predefined minimum extent.

For example, the door 102 may be held to the pushing member by a retention force. The retention force is in some embodiments, be provided by magnetic attraction between a magnetic element and a ferromagnetic material, one is located on the door and the other on the pushing member. As shown in FIGS. 3 and 7, a magnet 120 is attached to the door 102 and the rod 108 (or 108') is ferromagnetic and/or has on its bottom end a magnetic 128 oriented to attract the magnet 120 on the door. When the door is closed, the magnet 120 abuts the bottom end of the pushing member to which is attracted.

However, the retention force with which the magnet 120 is held is weaker than a force upon the door that arises by the pressure of the emission when the obscuration cloud generating canister 110 is activated. This way, the retention force does not prevent the door 102 from opening when the obscuration cloud generating canister 110 is activated.

Optionally or alternatively, door checking system 104 may also be operable to release the door 102 so that it opens, to allow free emission. For example, the pushing member may firstly be retracted to close the door 102. The door 102 is shaped so that it cannot move more inward than the closed position. The pushing member may then be further retracted inward to withdraw it from the door and break the magnetic bond holding the door to the pushing member. The releasing of the door in this or another manner may be done by an instruction from the controller 105, before controller 105 is activating the canister 110.

Reference is now made to FIGS. 9A, 9B, 9C, 9D, 9E and 9F, which are illustrations of a partial cross-section of an obscuration cloud generation device showing a mechanism for checking and opening the door, and an enlarged view thereof, with the door closed, with the door open for checking, and with the door fully open, respectively, according to some embodiments of the present invention.

Figure 9B:
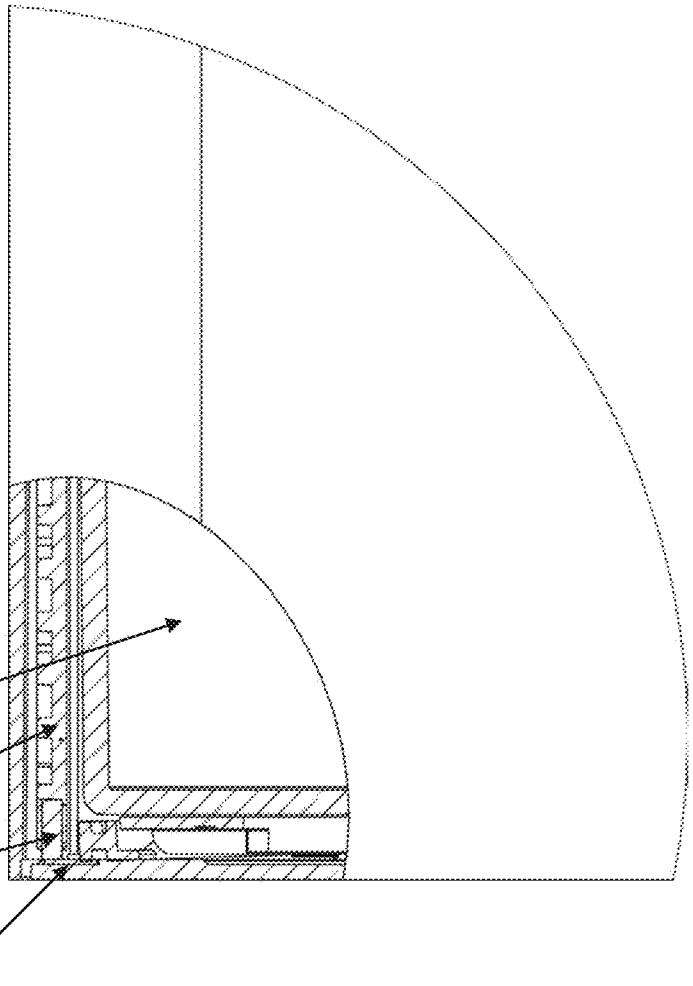
FIGS. 9A, 9B, 9C, 9D, 9E and 9F are illustrations of a partial cross-section of an obscuration cloud generation device showing a mechanism for checking and opening the door, and an enlarged view thereof, with the door closed, with the door open for checking, and with the door fully open, respectively, according to some embodiments of the present invention.
Figure 9A:
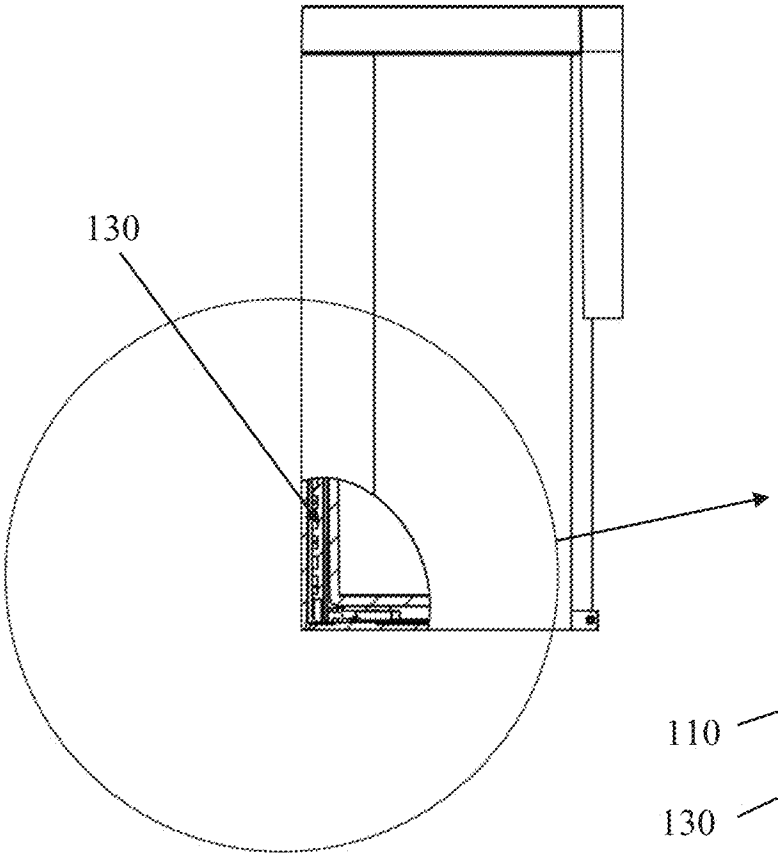
Figure 9D:
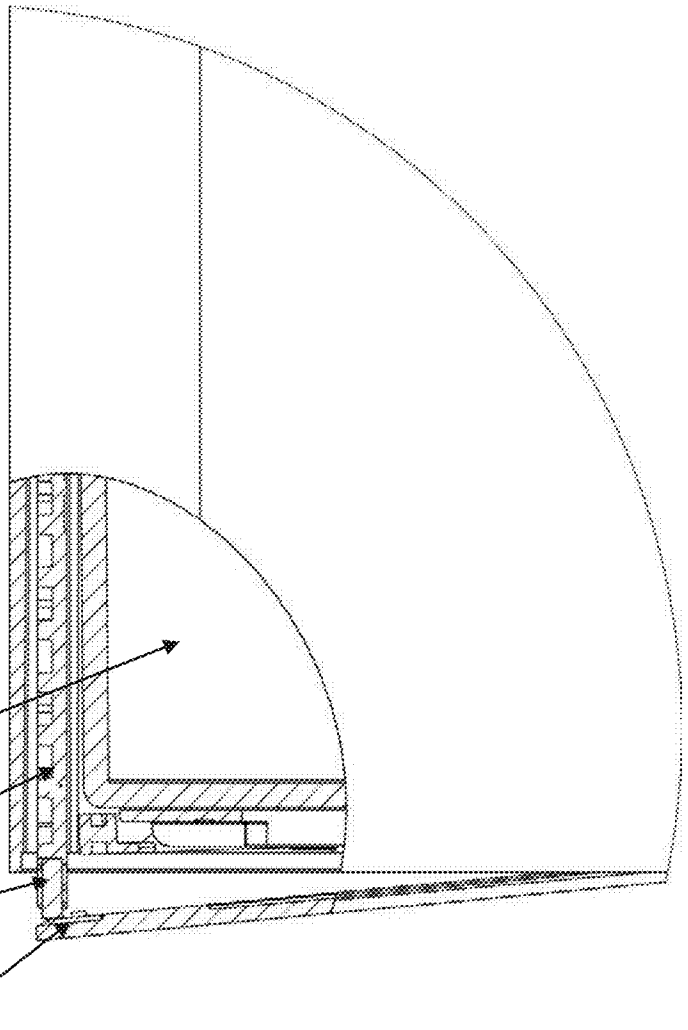
Figure 9C:
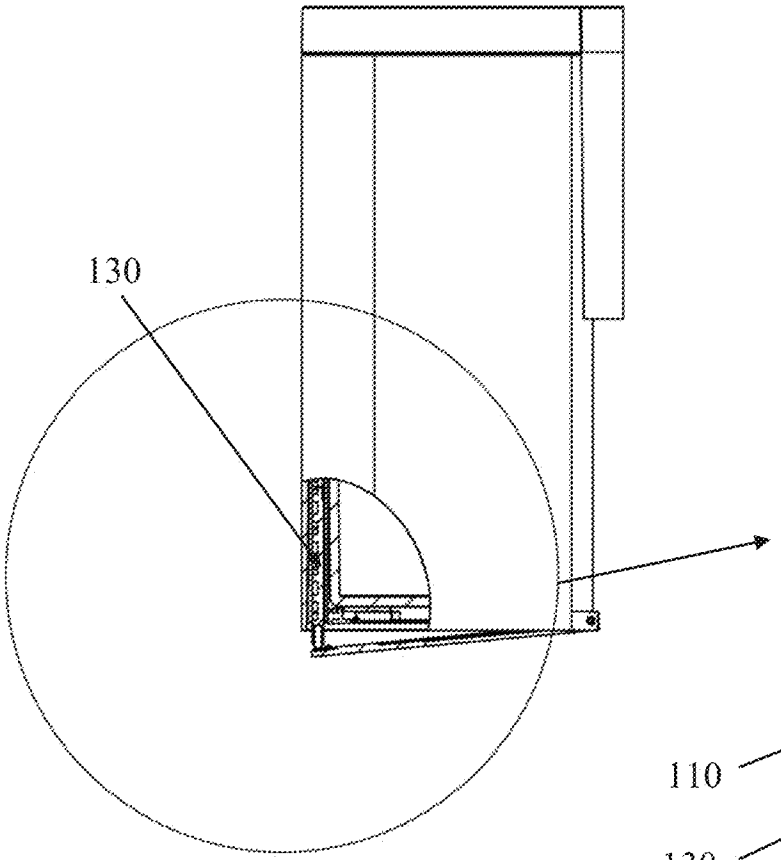

As shown at FIG. 9A and FIG. 9B, rod 130 holds the door 102, for example by a ferromagnetic material 128 on its bottom end to attract the magnet 120 on the door, as described above. The ferromagnetic material may be another magnet that is orientated to attract magnet 120. As shown at FIG. 9C and FIG. 9D, rod 130 is moved downward along the frame 103, as described for the rod 108 or 108', to check if the door 102 may be opened at least to the predefined minimum extent.

Figures 9E, 9F:
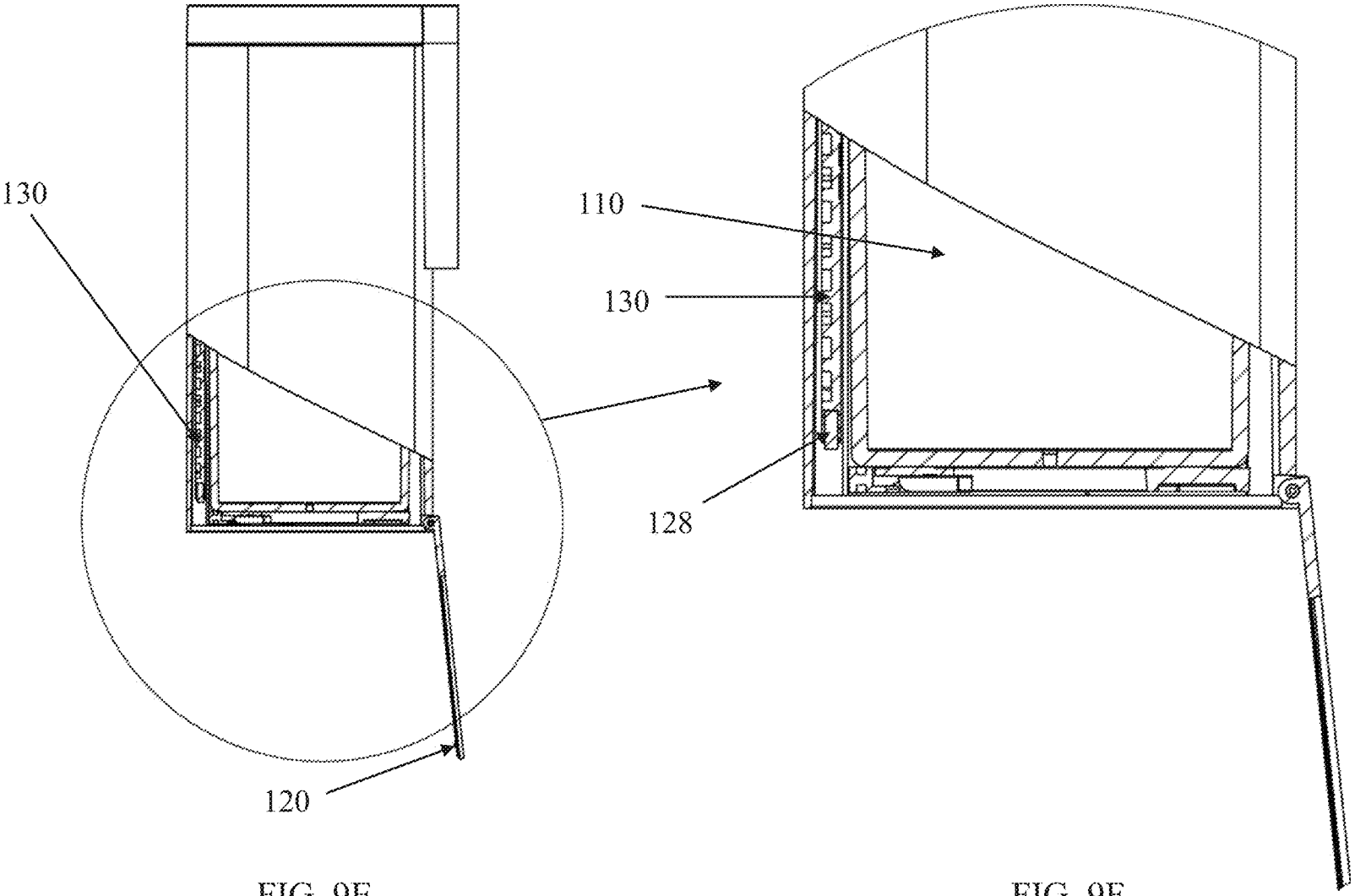

When the controller 105 received a request to activate the obscuration cloud generating canister 110, as described above, the controller 105 instructs the mechanism to release the door 102. As shown at FIG. 9E and FIG. 9F, rod 130 is moved upward along the frame 103, so the ferromagnetic material 128 is pulled away from magnet 120 to break the magnetic bond between the ferromagnetic material 128 and the magnet 120. This may be done, for example, by a motor-based or solenoid-based system, which is also used for checking the door 102. The rod 130 therefore may be moved between three positions—closed door position, door checking position (pushed out of the housing), and door releasing position (pulled inside the housing). Then, the magnet 120 of the door 102 is no longer held by the magnetic bond holding the door 102 to the rod 130, and is door 102 free to open, for example to be dropped open by the force of gravity. The door may also be opened, for example, by springs and/or any other pulling or pushing mechanism. Only then, when the door 102 is open, controller 105 activates the obscuration cloud generating canister 110, as described above. As will be appreciated, in an alternative embodiment the bottom end of the rod has a magnet, which magnetically bond with a ferromagnetic material on the door that is not a magnet.

When the door is pushed open by the force of emission, some residue material may be left on the inside of the door. The release mechanism has the advantage of the emitted material not impacting the door 102, and therefore not being deposited on the door 102 after the emission. When the obscuration cloud generating canister 110 is activated the door 102 is already open, for example by at least 90 degrees and/or to a vertical orientation.

Figure 10:
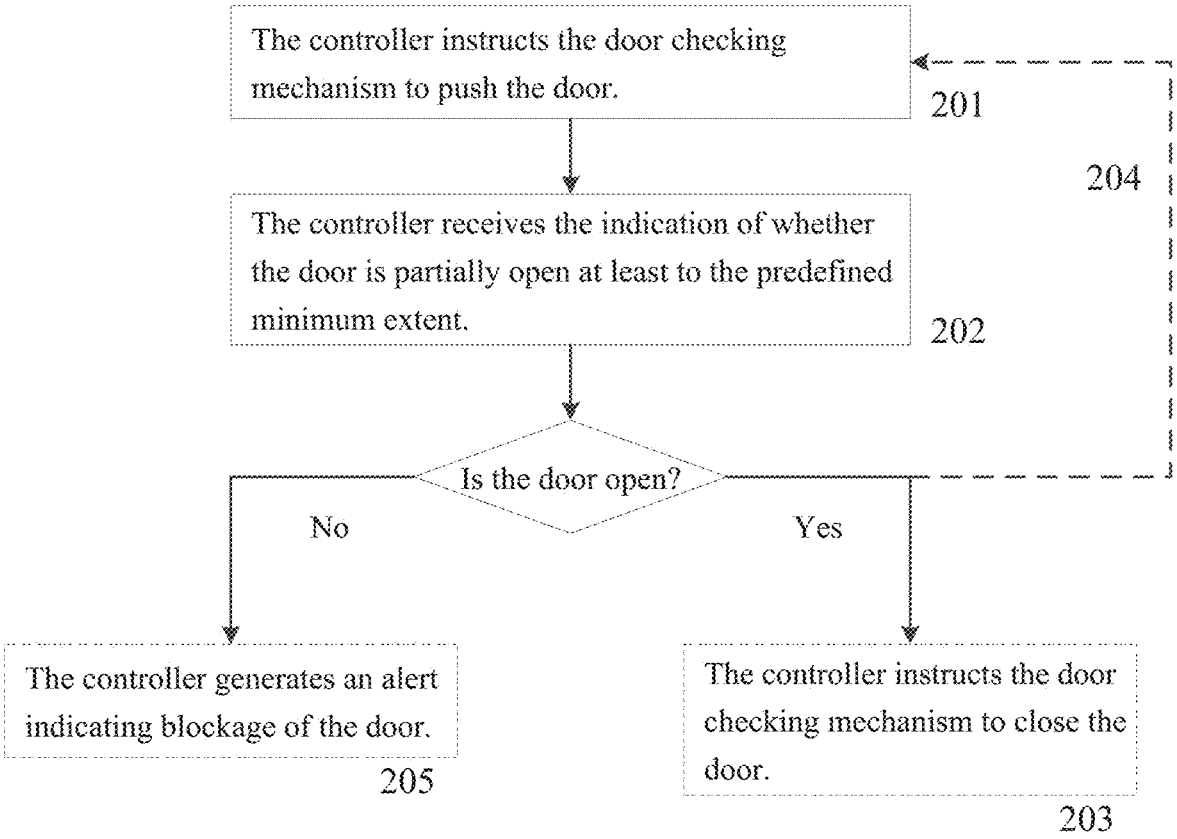
FIG. 10 is a flowchart schematically representing an exemplary method for operating an obscuration cloud generation device, according to some embodiments of the present invention.

A flowchart schematically representing an exemplary method for operating an obscuration cloud generation device, according to some embodiments of the present invention, is shown in FIG. 10. The method is executed by processing circuitry 106 of controller 105, which executes instructions stored in a memory 107. In the example described below, the motor 111 is used to apply a force for opening the door, and the indication of whether the door reaches the predefined minimum extent is provided as an output of a Hall Effect sensor, as described above. However, as will be appreciated the steps of the exemplified method are applicable for hardware having any of the other adaptions or variations described herein or as would be understood by the person skilled in the art.

First, as shown at 201, the controller 105 instructs the door checking system 104 to push the door 102.

The door checking system 104 then tries to open the door 102. This may be done by the rod 108 or 108' extending along the frame 103 from the controller 105 to the door 102, as a result of being pushed by the motor 111.

Then, as shown at 202, the controller 105 receives the indication of whether the door 102 is open at least to the predefined minimum extent from the Hall Effect sensor 115 of door checking system 104. The controller 105 determines an ability to operably activate the cloud generating canister 110 based on the indication such that it results in the emission of is obscuration cloud forming composition, from the housing, in the intended manner.

When the controller 105 determines that the obscuration cloud generating canister 110 is able to be operably activated, the controller 105 optionally instructs the door checking system 104 to close the door 102, as shown at 203, so the door 102 continues to keep the device 100 closed, since no instruction has yet been given to activate the canister.

Optionally, the process is repeated, as shown at 204, to re-check for any new obstruction. The process of checking whether the obscuration cloud generating canister 110 is able to be operably activated, by instructing the door checking system 104, receiving the indication, and determining operability, may be automatically done, periodically, for example every 10 minutes, every hour, every day and/or any other period or schedule.

When the controller 105 determines that the door 102 not open at least to the predefined minimum extent based on the indication, controller 105 generates an alert indicating blockage of the door 102 as shown at 205. The alert may be signaled from the device (for example to a human operator) and/or transmitted to another device (e.g. a monitoring hub of a security system). This provides an indication of sabotage or other obstruction, before the device is triggered.

Figure 11:
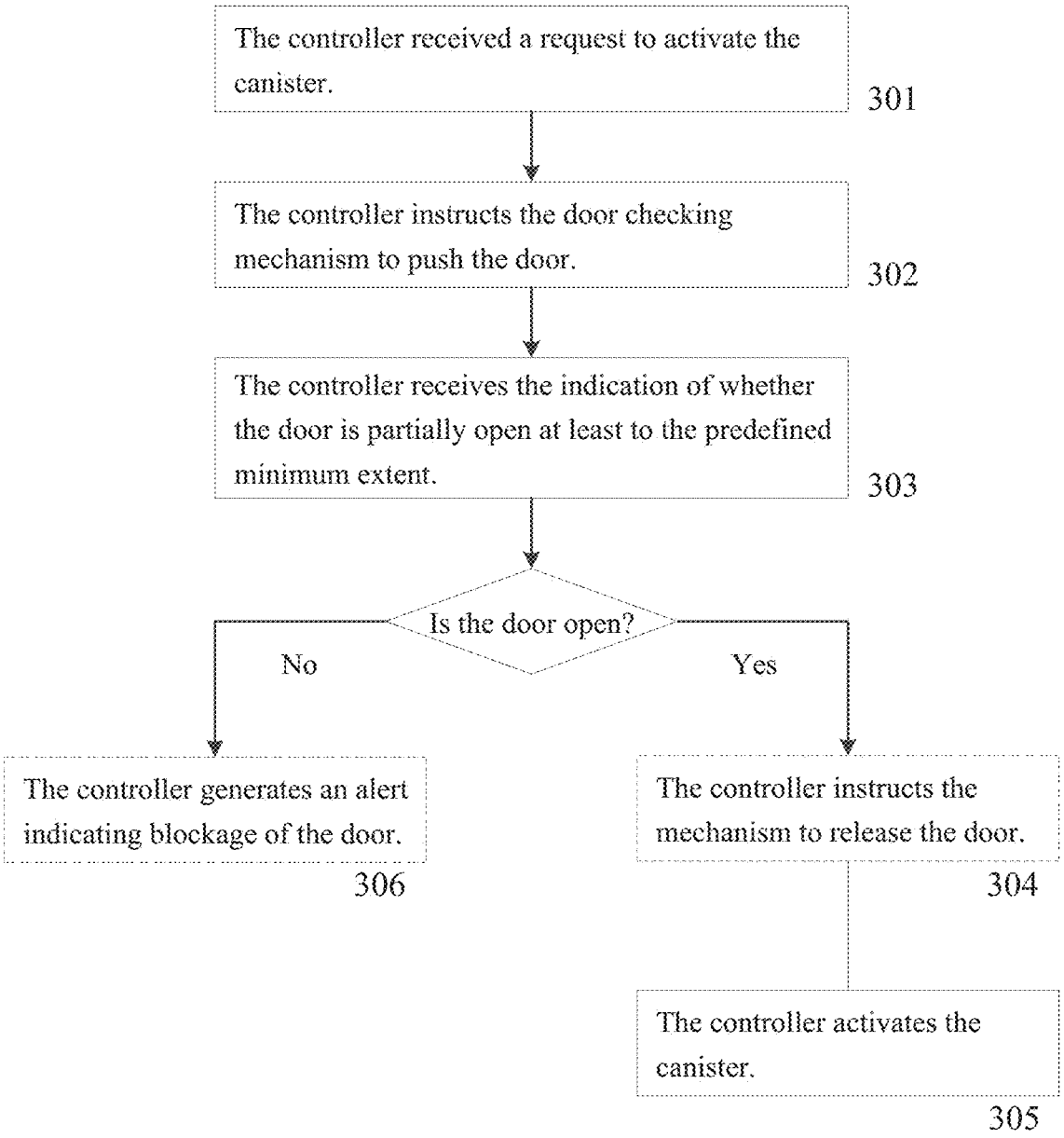
FIG. 11 is a flowchart schematically representing another exemplary method for operating an obscuration cloud generation device, according to some embodiments of the present invention.

The checking may also be done after the controller 105 received a request to activate the obscuration cloud generating canister 110. This saves energy by checking only before the device is triggered. A flowchart schematically representing an example of such a method for operating an obscuration cloud generation device, according to some embodiments of the present invention, is shown in FIG. 11. The method is executed by processing circuitry 106 of controller 105, which executes instructions stored in a memory 107. The steps of the exemplified method may be implemented on the hardware described above or on other hardware, as will be understood by the person skilled in the art.

First, as shown at 301, the controller 105 receives a request to activate the obscuration cloud generating canister 110. The request may be generated, for example, by a sensor on the device or received from a remote device.

Then, as shown at 302, the controller 105 instructs the door checking system 104 to push the door 102.

The door checking system 104 then tries to open the door 102, as described above.

Then, as shown at 303, the controller 105 receives the indication of whether the door 102 is open at least to the predefined minimum extent from the Hall Effect sensor 115 of door checking system 104. The controller 105 determines an ability to operably activate the cloud generating canister 110 based on the indication.

If the door is determined to be open, the controller 105 determines that the obscuration cloud generating canister 110 is able to be operably activated. Optionally, the controller instructs the mechanism to release the door 102, as shown at 304, so door 102 is opened by gravity. Then the controller 105 activates the obscuration cloud generating canister 110, as shown at 305.

Optionally, when the controller 105 determines that the door 102 not open at least to the predefined minimum extent based on the indication, controller 105 generates an alert indicating blockage of the door 102 as shown at 306 and as described above. The controller may thus avoid activating the canister while the door is in such a condition.

In the embodiments detailed herein, the door checking system applies a force for opening the door by pushing a component against the door, but in other embodiments the door may be opened in other ways. For example, rotating force may be applied at a hinge of the door.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant obscuration cloud generating devices will be developed and the scope of the term obscuration cloud generating device is intended to include all such new technologies a priori.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. An obscuration cloud generation device, comprising:

a housing having a door and a frame sized and shaped to accommodate an obscuration cloud generating canister when the door is in a closed state, wherein activation of the obscuration cloud generating canister emits a composition for forming the cloud and the door has an operably open state in which the door is open to at least a predefined minimum extent for exiting of the emitted composition from the housing;

a door checking system that applies a force for opening the door and generates an indication of whether the door is open at least to the predefined minimum extent; and a controller adapted to:

instruct the door checking system to apply the force for opening the door; and receive the indication of whether the door is open at least to the predefined minimum extent to determine, before activating the obscuration cloud generating canister, that the door is not blocked from reaching the operably open state.

2. The device according to claim 1, wherein the controller is further configured to activate the obscuration cloud generating canister in an event of a predefined condition being satisfied, the predefined condition including that the controller has:

received a request to activate the obscuration cloud generating canister; and determined that the door is not blocked from reaching the operably open state.

3. The device of claim 1, the controller is further adapted to:

when the indication indicates that the door has not opened at least to the predefined minimum extent, generate an alert indicating blockage of the door.

4. The device of claim 1, wherein the predefined minimum extent is a partially open state, and the door checking system pushes the door open to the partially open state, and an extent in which the door is open by the pressure of emission is substantially greater than the partially open state.

5. The device of claim 1, wherein before the activation of the cloud generating canister, the door is released to open to the operably open state.

6. The device of claim 5, wherein the door is released by a releasing member which is displaced to release a magnetic bond between the member and the door that holds the door.

7. The device of claim 5, wherein the door checking system comprises a pushing member extending along the frame and which is displaced to push the door.

8. The device of claim 7, wherein the door is released by a releasing member which is displaced to release a magnetic bond between the member and the door that holds the door; wherein the pushing member is the releasing member.

9. The device of claim 7, wherein the pushing member comprises at least one rod extending along the frame.

10. The device of claim 7, wherein the indication is determined, at least in part, by measuring a displacement of the pushing member; wherein the indication is determined, at least in part, by a predefined threshold of the displacement, wherein when the displacement is below the predefined threshold, the door is not considered to have reached the predefined minimum extent of being open.

11. The device of claim 7, wherein the door checking system is operable to close the door by retracting the pushing member.

12. The device of claim 11, wherein the door is held to the pushing member by a retention force which is weaker than a force upon the door that arises by the pressure of the emission when the obscuration cloud generating canister is activated.

13. The device of claim 12, wherein the retention force is provided by a first magnetic element on one of the door and the pushing member, which is attracted to a ferromagnetic material, wherein the other of the door and the pushing member comprises the ferromagnetic material.

14. The device of claim 1, wherein the controller is further adapted to periodically generate the instruction, receive the indication and determine an ability.

15. The device of claim 1, wherein the obscuration cloud is a smoke cloud.

16. A system comprising:

the device of claim 1; and an obscuration cloud generating canister;

wherein the predefined minimum extent is a partially open state, and the door checking system pushes the door open to the partially open state, and an extent in which the door is open by the pressure of emission is substantially greater than the partially open state.

17. A computer-implemented method of operating an obscuration cloud generation device that is activatable to emit a composition for forming the cloud, the method comprising:

instructing a door checking system to apply a force for opening a door of a housing, the housing having a frame sized and shaped to accommodate an obscuration cloud generating canister when the door is in a closed state, wherein activation of the obscuration cloud generating canister emits a composition for forming the cloud and the door has an operably open state in which the door is open to at least a predefined minimum extent for exiting of the emitted composition from the housing;

verifying that the door is open to at least the predefined minimum extent; and in response to a received request to activate the obscuration cloud generating canister and a verification that the door is open at least the predefined minimum extent, activating the obscuration cloud generating canister.

18. A non-transient computer readable medium comprising computer executable instructions adapted to, upon being read by a processing circuitry, cause a system comprising the processing circuitry, to perform the method of claim 17.

* * * * *